US009410309B2

(12) United States Patent
Sharratt et al.

(10) Patent No.: US 9,410,309 B2
(45) Date of Patent: Aug. 9, 2016

(54) WALL SHOWER BAR ASSEMBLY

(71) Applicant: Waxman Consumer Products Group Inc., Bedford Heights, OH (US)

(72) Inventors: Jason A. Sharratt, Wadsworth, OH (US); Matthew Smith, Wooster, OH (US)

(73) Assignee: Waxman Consumer Products Group Inc., Bedford Heights, OH (US)

( * ) Notice: Subject to any disclaimer, the term of this patent is extended or adjusted under 35 U.S.C. 154(b) by 207 days.

(21) Appl. No.: 13/955,656

(22) Filed: Jul. 31, 2013

(65) Prior Publication Data

US 2015/0033470 A1 Feb. 5, 2015

(51) Int. Cl.

| | |
|---|---|
| ***E03C 1/02*** | (2006.01) |
| ***E03C 1/04*** | (2006.01) |
| ***B05B 1/18*** | (2006.01) |
| ***B05B 1/16*** | (2006.01) |
| ***E03C 1/06*** | (2006.01) |

(52) U.S. Cl.

CPC ..... *E03C 1/0408* (2013.01); *B05B 1/1672* (2013.01); *B05B 1/18* (2013.01); *E03C 1/025* (2013.01); *E03C 1/066* (2013.01)

(58) Field of Classification Search

CPC ..... E03C 1/0408; E03C 1/02; E03C 1/021; E03C 1/025; E03C 1/04; E03C 1/06; E03C 1/066; B05B 1/14; B05B 1/16; B05B 1/1627; B05B 1/1636; B05B 1/1672; B05B 1/1681; B05B 1/18; B05B 1/185

USPC ..... 4/601, 695, 615; 239/443–449

See application file for complete search history.

(56) References Cited

U.S. PATENT DOCUMENTS

| | | | | |
|---|---|---|---|---|
| 3,121,235 | A * | 2/1964 | Gellmann | 4/570 |
| 4,901,927 | A | 2/1990 | Valdivia | |
| D517,669 | S | 3/2006 | Zieger et al. | |
| 7,043,776 | B1 | 5/2006 | Wu | |
| 7,222,828 | B2 | 5/2007 | Zhadanov et al. | |
| 7,299,510 | B2 | 11/2007 | Tsai | |
| D559,949 | S | 1/2008 | Bickler et al. | |
| D564,625 | S | 3/2008 | Bickler et al. | |
| D594,531 | S | 6/2009 | Daunter et al. | |

(Continued)

OTHER PUBLICATIONS

Catalog Entitled "Ateck® 2001-2011", published by Ateck (Xiamen) Showers Co., Ltd., No. 2 Factory, Dianqianshe, Gaodian, Dianqian St., Hull, Xiamen, Fujian, China. (28 pages).

*Primary Examiner* — J. Casimer Jacyna

(74) *Attorney, Agent, or Firm* — Tarolli, Sundheim, Covell & Tummino LLP

(57) ABSTRACT

A wall shower bar assembly (100) mounted to a shower wall (10). The wall shower bar assembly (100) includes: a tube assembly (200), an upper retainer assembly (300) for coupling an upper portion (102) of the bar assembly to a water supply pipe (12), and a lower retainer assembly (400) for coupling a lower portion (104) of the bar assembly to the wall. The upper and lower retainer assemblies (300, 400) define a dual joint connection structure (110) including an upper spheroidal joint connection assembly (112) and a lower pivot joint connection assembly (114). Both the upper and lower joint connection assemblies (112, 114) permit relative pivoting movement of the bar assembly (200) about pivot axes (P1, P2) substantially parallel to the wall. The lower retainer assembly 400 includes a suction cup retaining assembly (410) including a camming mechanism (420) for securing a section cup (412) to the wall.

20 Claims, 10 Drawing Sheets

(56) References Cited

U.S. PATENT DOCUMENTS

| | | | | |
|---|---|---|---|---|
| 7,708,245 | B2 | 5/2010 | Woo | |
| D621,002 | S | 8/2010 | Yongyan | |
| 7,857,241 | B2 | 12/2010 | Deng | |
| D638,514 | S | 5/2011 | Farley | |
| D639,391 | S | 6/2011 | Yongyan | |
| 8,024,822 | B2 | 9/2011 | Macan et al. | |
| 8,123,181 | B2 | 2/2012 | Choi | |
| D665,873 | S | 8/2012 | Wilson | |
| 8,292,253 | B2 | 10/2012 | Zhadanov | |
| 8,382,051 | B2 | 2/2013 | Smith | |
| 8,429,769 | B2 | 4/2013 | Gross | |
| D689,983 | S | 9/2013 | Wilson | |
| D699,325 | S | 2/2014 | Bailey | |
| D705,392 | S | 5/2014 | Bailey | |
| D705,896 | S | 5/2014 | Bailey | |
| D705,900 | S | 5/2014 | Bailey | |
| 2006/0230520 | A1 | 10/2006 | Tsai | |
| 2006/0242759 | A1 | 11/2006 | Tsai | |
| 2007/0158460 | A1 | 7/2007 | Lev | |
| 2009/0265848 | A1* | 10/2009 | Tsai | 4/615 |
| 2009/0266913 | A1 | 10/2009 | Tsai | |
| 2010/0024909 | A1 | 2/2010 | Lu et al. | |
| 2010/0180967 | A1 | 7/2010 | Deng | |
| 2011/0277231 | A1* | 11/2011 | Zhadanov et al. | 4/601 |
| 2013/0042937 | A1* | 2/2013 | Cai | 137/861 |
| 2013/0269793 | A1* | 10/2013 | Tsai | 137/343 |
| 2013/0283524 | A1* | 10/2013 | Schulte | 4/695 |

* cited by examiner

WALL SHOWER BAR ASSEMBLY

TECHNICAL FIELD

The present invention relates to a wall shower bar assembly including a fixed shower head and a hand-held shower mounted to a tubular bar and, more particularly, to a wall shower bar assembly including an upper retainer assembly including a spheroidal joint connection assembly that pivotally couples an upper portion of the wall shower bar assembly to a water supply pipe and a lower retainer assembly including a hinged joint connection assembly that pivotally couples a lower portion of the wall shower bar assembly to a shower wall.

BACKGROUND

Wall shower bar assemblies are used in shower stalls, shower enclosures, tub and shower surrounds, and the like, where it is desired to have the option of using either a fixed shower head or a hand-held sprayer shower coupled for washing and/or rinsing purposes. Typically, the hand-held sprayer shower is supplied water by a flexible water supply hose, which is coupled to a diverter valve. The diverter valve allows the user to select water flow between the fixed shower head and the hand-held sprayer shower. A tube assembly (sometimes referred to as a wall bar) is provided which mounts to a support surface such as a wall of the shower stall. The shower head is coupled to an upper end of the tube assembly, while the hand-held sprayer shower is supported on a seat slidably affixed to a vertically mounted tube of the tube assembly.

Typical prior wall shower bar assemblies are shown, for example, in U.S. Published Patent Application Pub. No. US 2009/0266913 (publication date Oct. 29, 2009) to Tsai and U.S. Published Patent Application Pub. No. US 2010/0024909 (publication date Feb. 4, 2010) to Lu et al. A connector at an upper portion of the tube of the tube assembly is typically coupled to a water supply pipe extending from a shower wall via a ball joint assembly. The shower head, in turn, is connected to the connector. The lower portion of the tube is coupled to the shower wall by a retainer assembly, which fixes the lower portion of the tube with respect to the shower wall.

Several shortcomings exist with respect to prior wall bar shower bar assemblies. When a ball joint assembly is used to affix the upper portion of the tube assembly to the water supply pipe, over-tightening is a problem. Typically, wrench flats would be provided on an outer surface of a coupling collar, which was threaded onto mating threads of the wall supply pipe. The desire to insure a water-tight connection often resulted in an installer (especially a do-it-yourself, novice installer) applying excessive torque to the coupling collar via a wrench positioned on the wrench flats. Excessive torque applied to the ball joint assembly could result in damage to the ball joint assembly and/or the water supply pipe.

Moreover, because in a typical prior wall bar shower assembly, the retainer assembly positions and secures the lower portion of the tubular bar at a fixed location with respect to the shower wall. This retainer assembly does not allow for relative movement between the tube and the shower wall. Stated another way, the retainer assembly of prior wall bar shower assemblies provide for a fixed position of the tube with respect to the shower wall. This configuration of prior wall bar shower assemblies makes repair, disconnection or adjustment of the wall bar shower assembly difficult. Generally, to repair any of the internals of the upper portion of the tube assembly, the entire prior wall bar shower assembly would have to be removed from the shower wall and the water supply pipe including disconnecting the ball joint assembly from the water supply pipe and disconnecting the retainer assembly from the shower wall or support structure.

SUMMARY

One exemplary embodiment of the present disclosure includes a wall shower bar assembly for mounting to a shower wall and a water supply pipe extending from the shower wall, the wall shower bar assembly comprising: a) a tube assembly including a tube, a manifold affixed to an upper end of the tube, and a shower head, the manifold including a first end and a second end, the shower head coupled to the second end of the manifold; b) an upper retainer assembly coupling the tube assembly to the water supply pipe, the upper retainer assembly including an upper joint connection assembly having a first coupler releasably affixed to the water supply pipe, a collar affixed to the first end of the manifold and a first connector coupling the coupler and the collar for relative movement between the coupler and the collar; and c) a lower retainer assembly coupling the tube assembly to the shower wall, the lower retainer assembly including a retainer body affixed to a lower end of the tube, a wall attachment assembly releasably affixed to the shower wall, and a lower joint connection assembly, the lower joint connection assembly including a first member extending from the retainer body, a second member extending from the attachment assembly, and a second connector coupling the first and second members for relative movement between the first and second members.

In one exemplary embodiment of the wall shower bar assembly of the present disclosure, the first connector of the upper joint connection assembly comprises a spheroidal joint for ball joint movement between the coupler and the collar.

In one exemplary embodiment of the wall shower bar assembly of the present disclosure, the second connector of the lower joint connection assembly comprises a hinge joint for pivoting movement between the first and second members.

In one exemplary embodiment of the wall shower bar assembly of the present disclosure, the attachment assembly includes a suction cup attachment assembly comprising a flexible suction cup, a suction cup housing supporting the suction cup, and a camming mechanism including an advancement ring to contact and urge the suction cup against the shower wall.

BRIEF DESCRIPTION OF THE DRAWINGS

The foregoing and other features and advantages of the present invention will become apparent to one skilled in the art to which the present invention relates upon consideration of the following description of the invention with reference to the accompanying drawings, wherein like reference numerals refer to like parts unless described otherwise throughout the drawings and in which.

DETAILED DESCRIPTION

Figure 1:
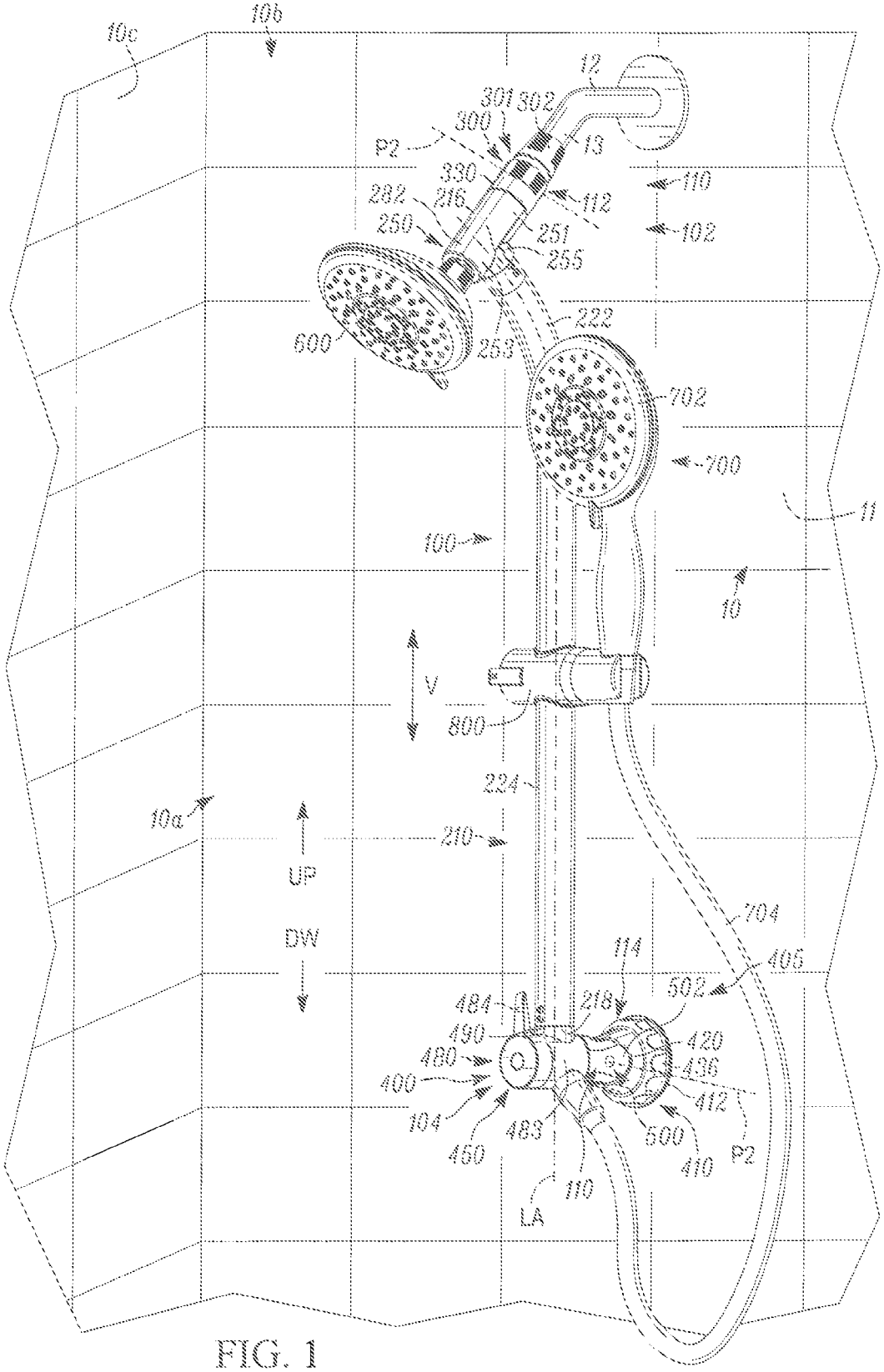
FIG. 1 is a schematic front, right perspective view of the wall shower bar assembly of the present disclosure, as mounted to a vertical wall of a shower stall or tub or shower surround or enclosure.
Figure 2:
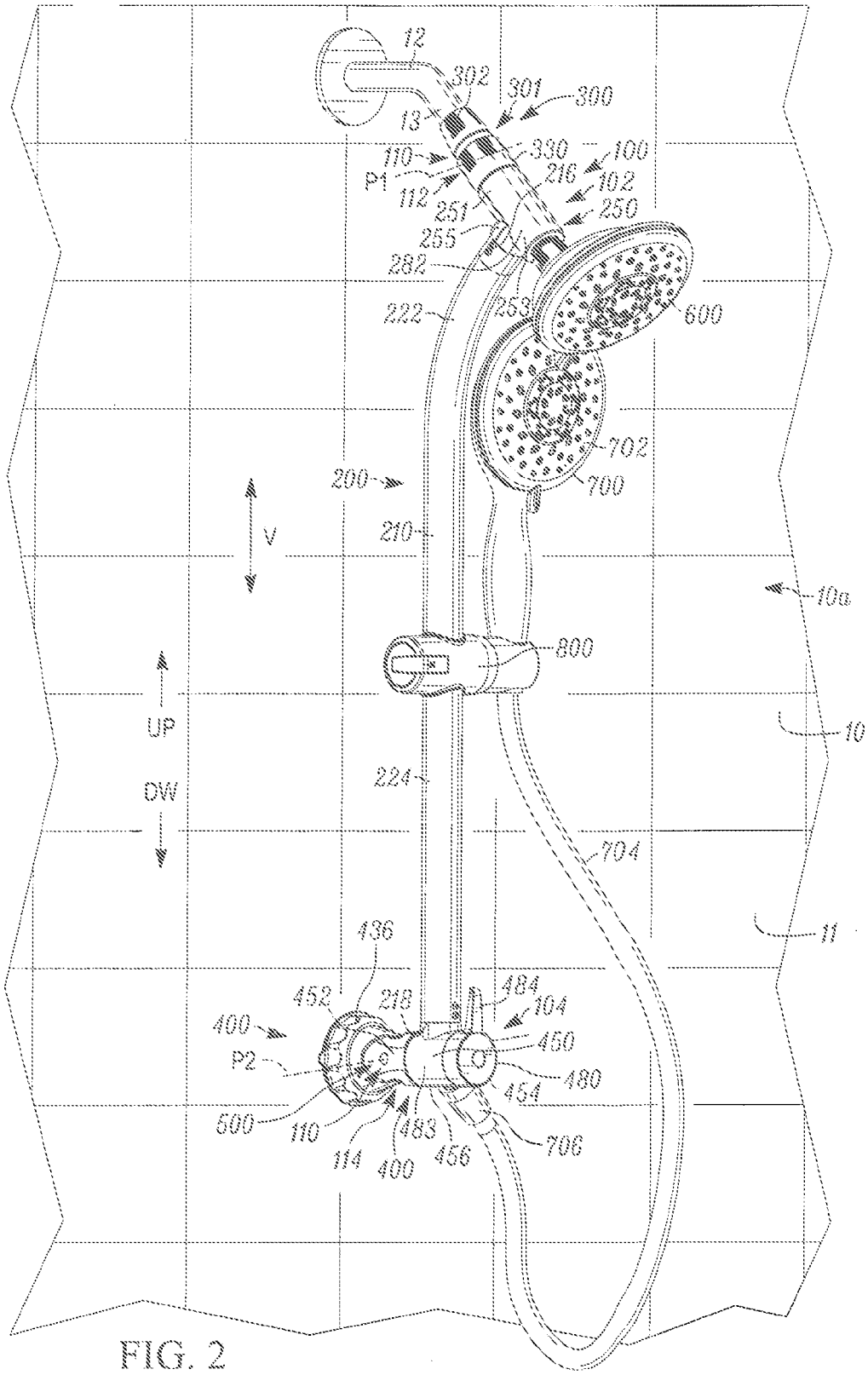
FIG. 2 is a schematic front, left perspective view of the wall shower bar assembly of FIG. 1, as mounted to a vertical wall of a shower stall or tub or shower surround or enclosure.
Figure 3:
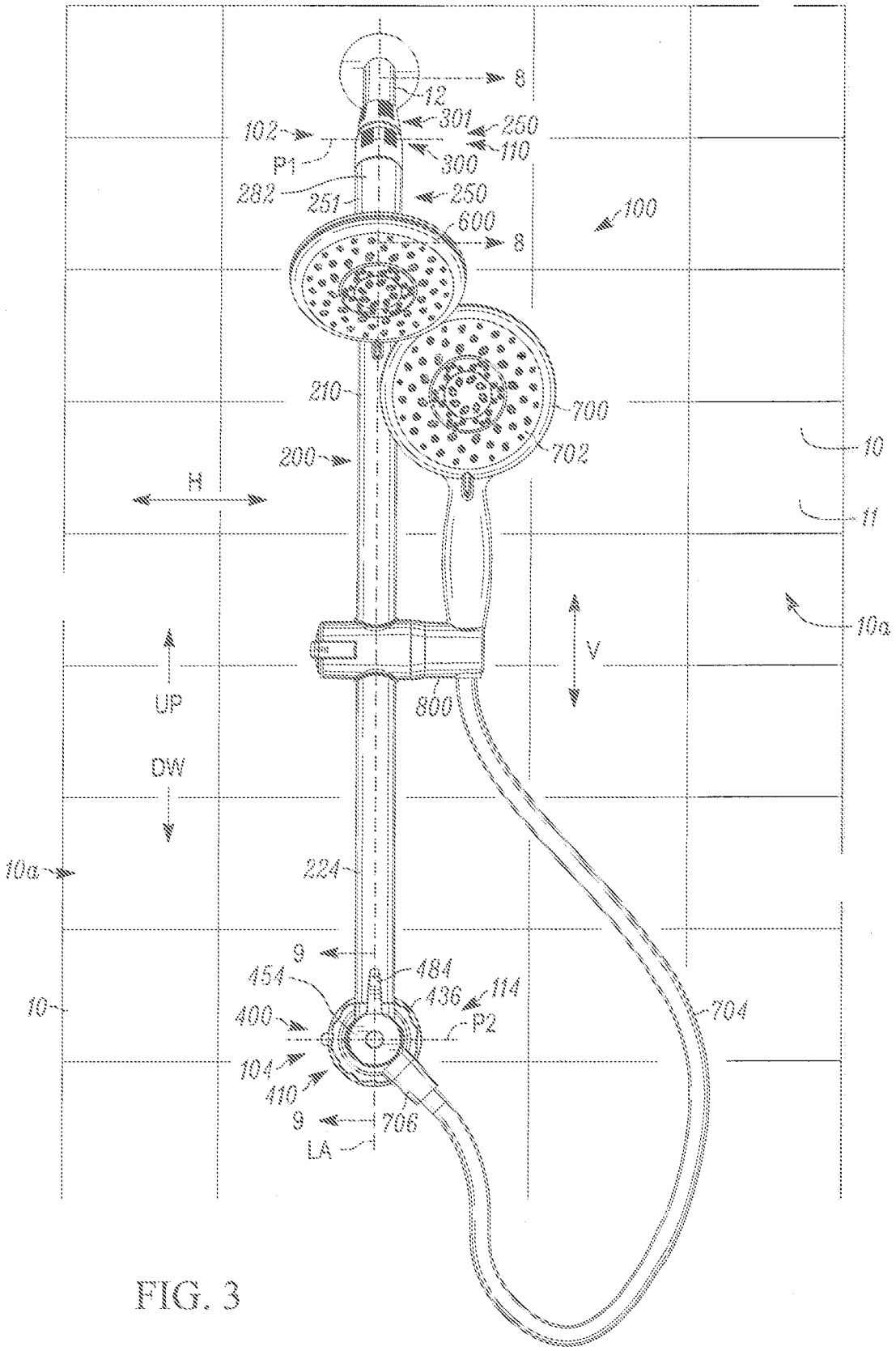
FIG. 3 is a schematic front elevation view of the wall shower bar assembly of FIG. 1, as mounted to a vertical wall of a shower stall or tub or shower surround or enclosure.
Figure 4:
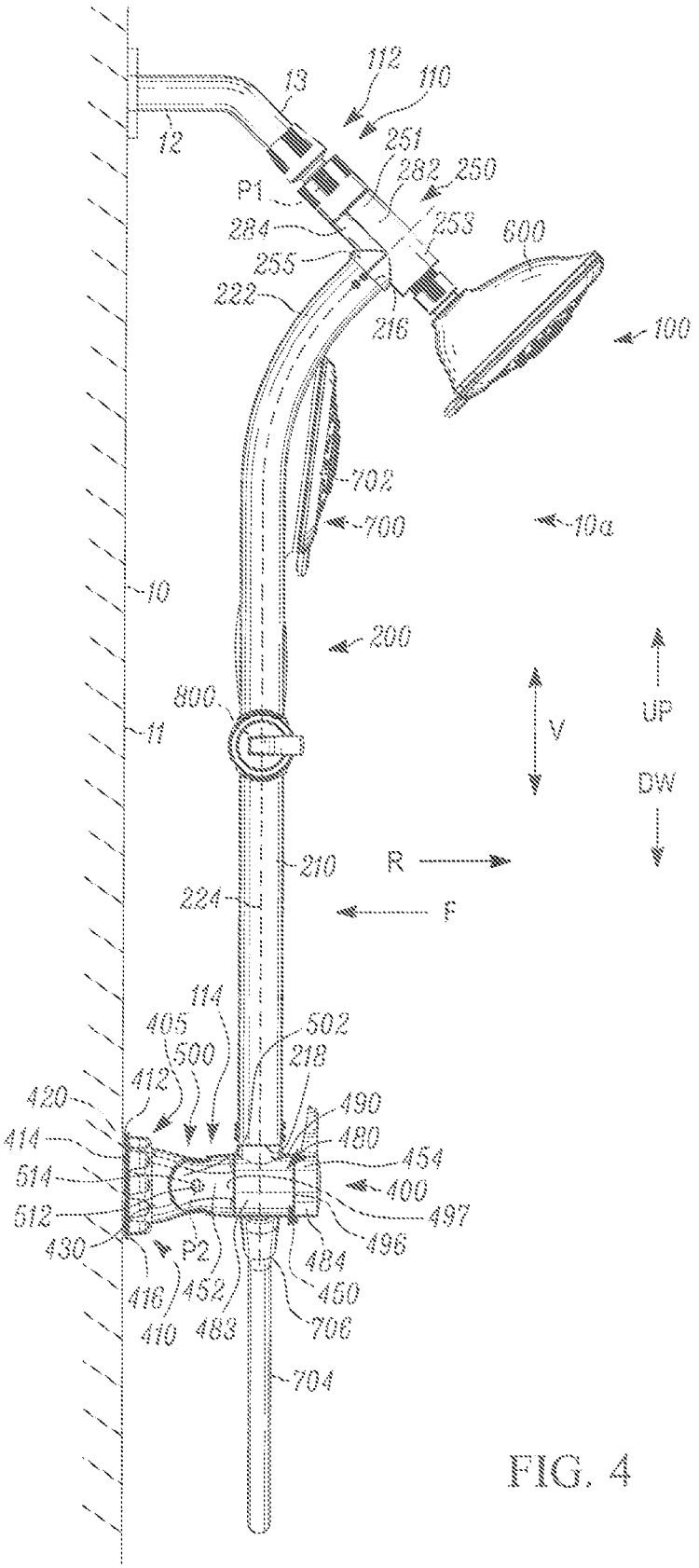
FIG. 4 is a schematic left side elevation view of the wall shower bar assembly of FIG. 1, as mounted to a vertical wall of a shower stall or tub or shower surround or enclosure.
Figure 5:
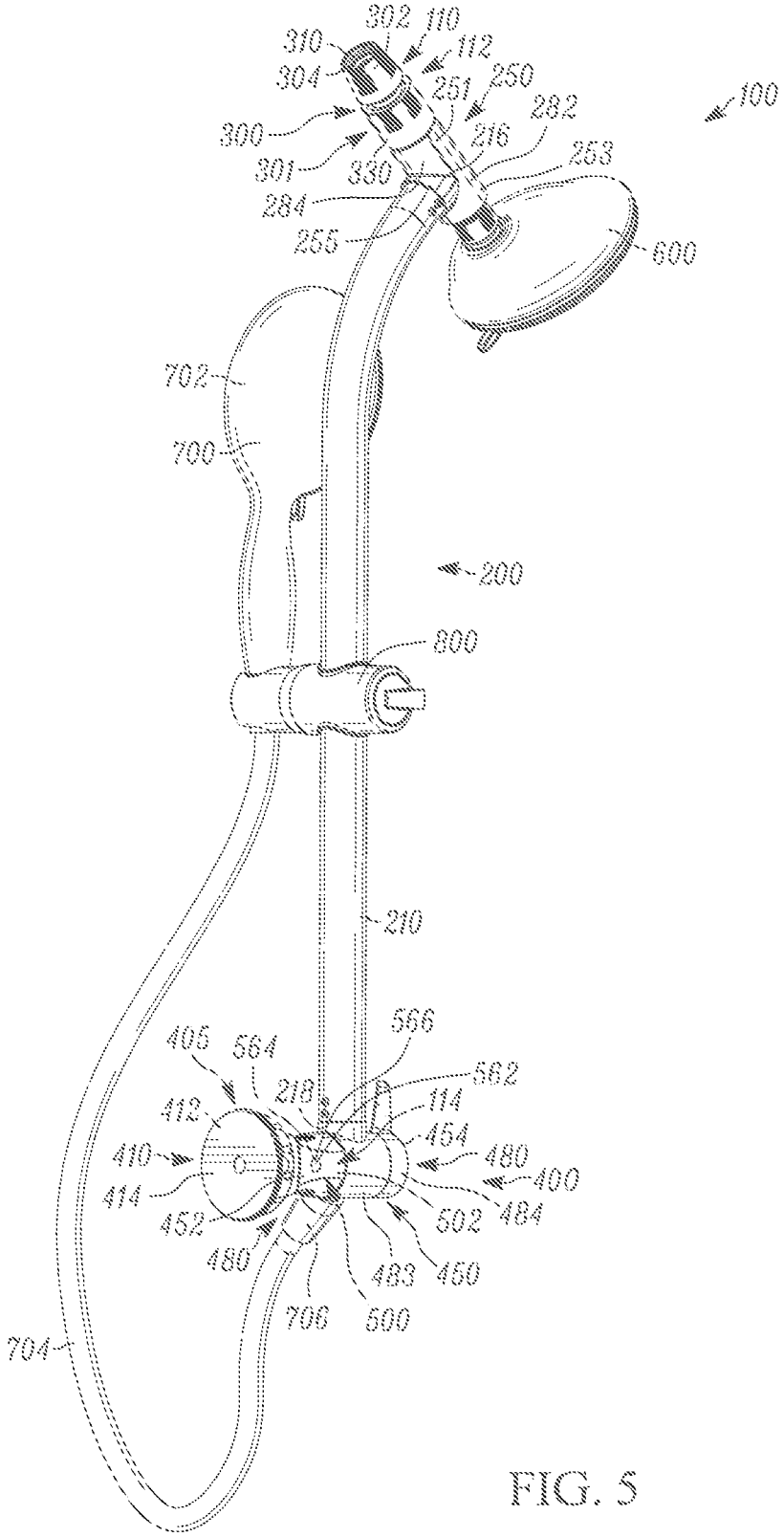
FIG. 5 is a schematic back or rear perspective view of the wall shower bar assembly of FIG. 1.

The present disclosure provides for a wall shower bar assembly, shown generally at 100 in the FIGS. 1-6, for installation in a tub or shower enclosure or surround or a shower stall 10*a*. FIGS. 1-4 schematically depict the wall shower bar assembly 100 installed on a vertical front wall 10 of a shower stall 10*a*. The wall shower bar assembly 100 supports and provides for selective water flow through a fixed shower head 600 or a hand-held sprayer shower 700. A two-position diverter valve 480 is provided to allow a user to select between the shower head 600 and the hand-held sprayer shower 700. The wall shower bar assembly 100 is affixed to a support surface such as the generally vertically oriented shower stall front wall 10 and is also affixed to and receives water from a water supply pipe 12 extending outwardly from the front shower wall 10 into an interior region 10*b* defined by the shower stall 10*a*. The front shower wall 10 defines a generally vertically extending planar mounting surface 11 for the wall shower bar assembly 100. In the schematic depiction of FIG. 1, the wall shower bar assembly is mounted to the front shower wall 10. Portions of the front shower wall 10 and a side shower wall 10*c*, which extends generally perpendicularly from the front shower wall 10, are schematically depicted in FIG. 1.

Figure 9:
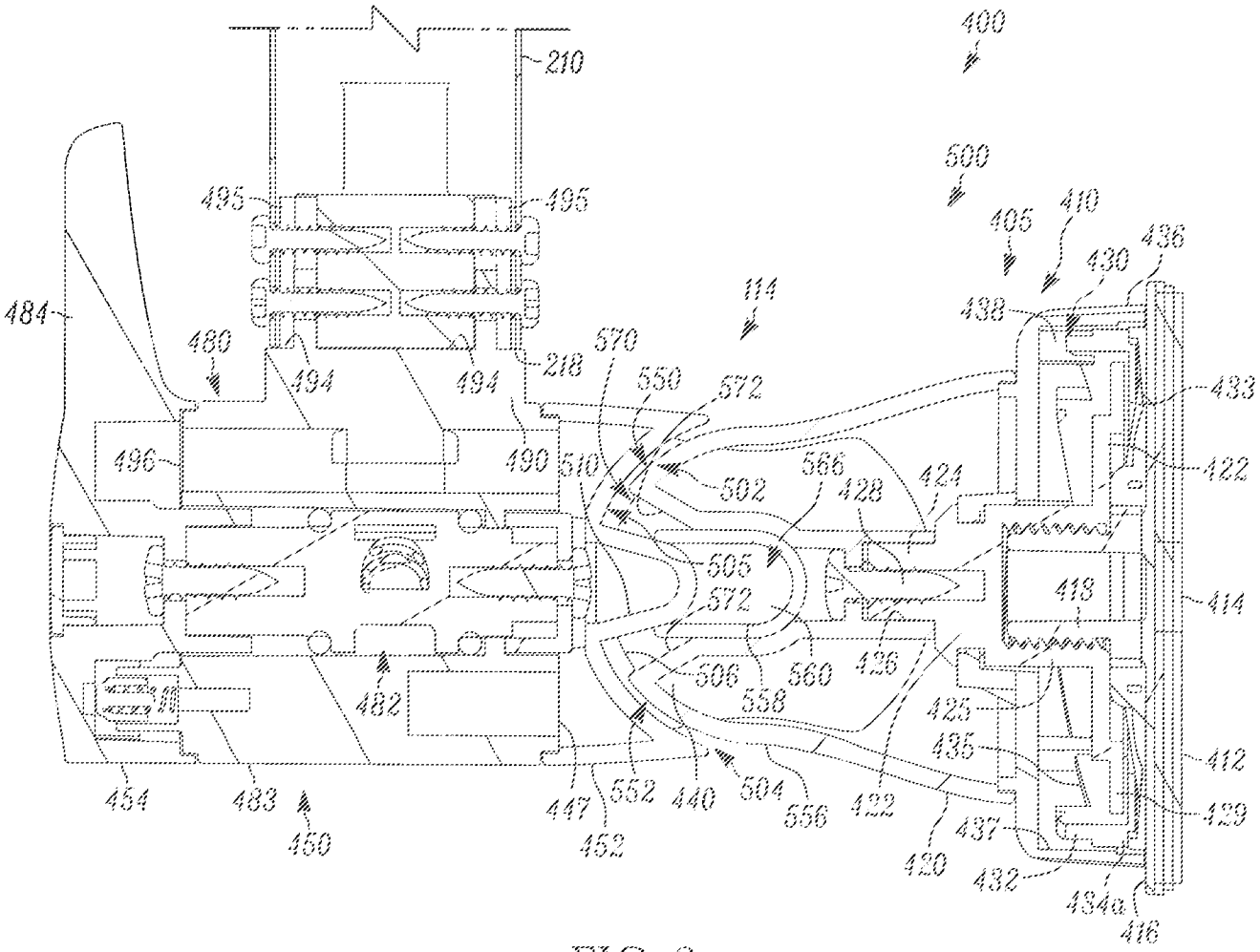
FIG. 9 is a schematic section view through a lower portion of the wall shower bar assembly of FIG. 1, including the lower retainer assembly, as seen from a plane indicated by the line 9-9 in FIG. 3.
Figure 10:
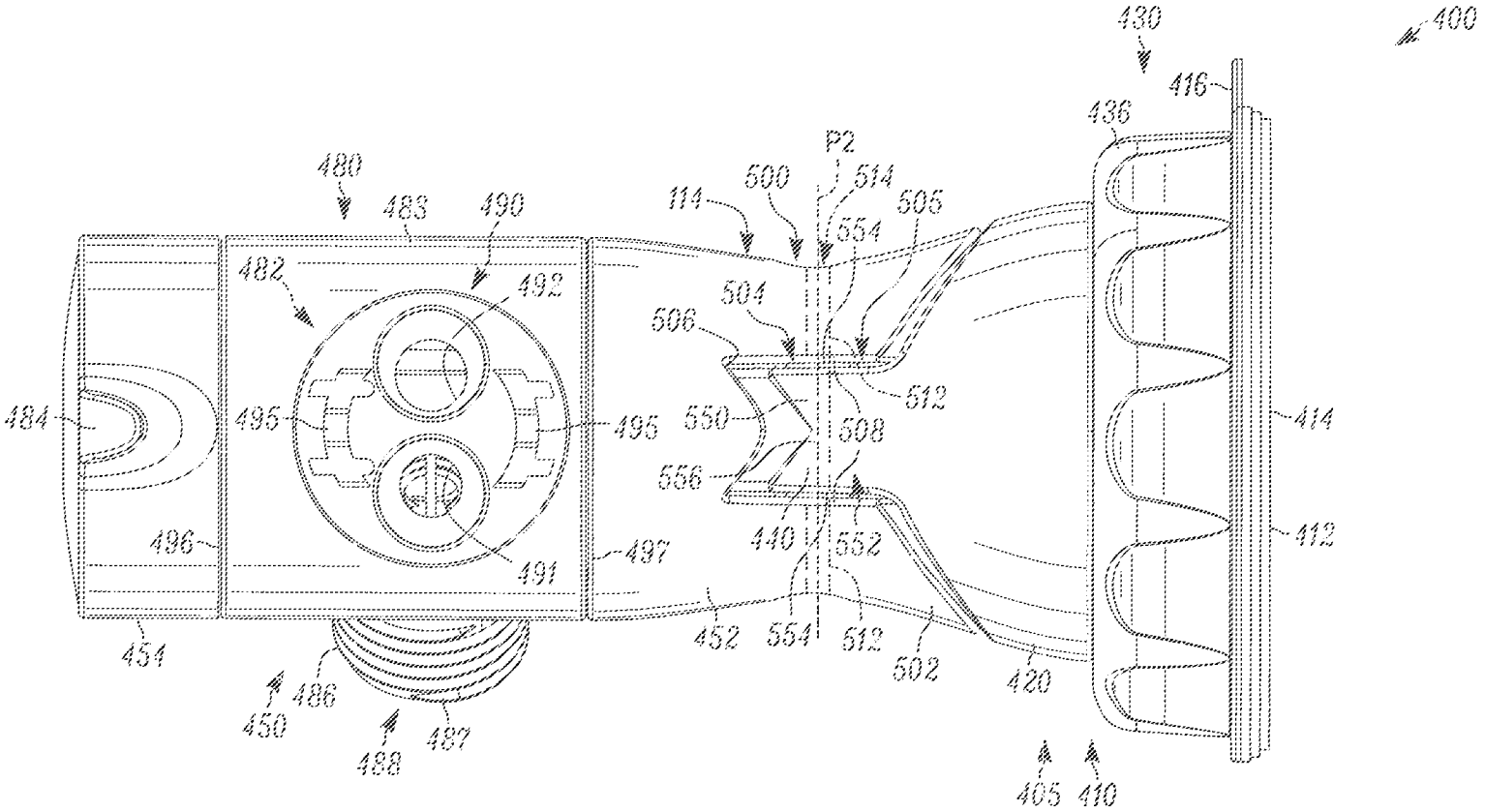
FIG. 10 is schematic top plan view of the lower retainer assembly of the wall shower bar assembly of FIG. 1.

Advantageously, the wall shower bar assembly 100 of the present disclosure uses a dual joint connection structure 110 that includes an upper joint connection assembly 112 (FIG. 12) and a lower joint connection assembly 114 (FIGS. 9 and 10). In one exemplary embodiment, the upper joint connection assembly 112 comprises a spheroidal or ball-and-socket joint providing a jointed coupling between an upper portion 102 of the wall shower bar assembly 100 and the water supply pipe 12. In one exemplary embodiment, the lower joint connection assembly 114 comprises a pivot joint providing a pivoting or hinged coupling between a lower portion 104 of the wall shower bar assembly 100 and the shower wall 10. The upper joint connection assembly 112 is part of an upper retainer assembly 300, while the lower joint connection assembly 114 is part of a lower retainer assembly 400.

For illustration and orientation purposes only and not by way of any limitation, a vertical direction V (FIGS. 3 and 4) is generally parallel to the planar surface 11 of the shower wall 10, a horizontal direction H (FIG. 3) is generally orthogonal to the vertical direction V, a forward direction F (FIG. 4) shall be in a direction from the shower stall interior 10*b* toward the shower wall 10, and the back or rearward direction R (FIG. 4) shall be in a direction away from the shower wall 10 toward the interior region 10*b*/The forward direction F and the rearward direction R are generally parallel to the side shower wall 10*e* (FIG. 1), while the horizontal direction H is generally parallel to the front shower wall 10. An upward direction UP (FIGS. 3 and 4) shall be in a direction upward from a floor of the shower stall 10*a*, while a downward direction DW (FIGS. 3 and 4) shall be in a direction toward the floor of the shower stall. Typically, the water supply pipe 12 extends horizontally outwardly from the shower wall 10 and at a distal portion 13 of the pipe 12, angles slightly downwardly. The distal portion 13 of the water supply pipe 12 includes a threaded external end 14. The upper portion 102 of the wall shower bar assembly 100 is adapted to be threadedly coupled to the threaded external end 14 of the water supply pipe 12.

Thus, the wall shower bar assembly 100 has two points of suspension or attachment with respect to the shower stall 10*a*, the upper portion 102 of the wall shower bar assembly 100 being releasably affixed to the water supply pipe 12 by the upper retainer assembly 300 and the lower portion 104 of the wall shower bar assembly 100 being releasably affixed to the planar surface 11 defined by the shower wall 10 by the lower retainer assembly 400. Advantageously, in the wall shower bar assembly 100 of the present disclosure, the upper joint connection assembly 112, which is part of the upper retainer assembly 300, couples or releasably engages the upper portion 102 of the wall shower bar assembly 100 and the threaded external end 14 of the water supply pipe 12 and provides for relative ball joint or universal joint movement between the upper portion 102 of the wall shower bar assembly 100 and the water supply pipe 12. The lower joint connection assembly 114, which is part of a lower retainer assembly 400, couples or releasably engages the lower portion 104 of the wall shower bar assembly 110 and the shower wall 10 and provides for relative hinge joint or pivot joint movement between the lower portion 104 of the wall shower bar assembly 100 and the shower wall 10.

It should be appreciated, of course, that the ball joint coupling between the upper portion 102 of the wall shower bar assembly 100 and the water supply pipe 12 afforded by the upper joint connection assembly 112 also necessarily encompasses a pivot joint coupling, that is, if the upper portion 102 of the wall shower bar assembly 100 is moved upward and downward in the vertical direction V, i.e., moved upward and downward parallel to the planar mounting surface 11 of the shower wall 10, the ball joint coupling will function as a hinged or pivot joint characterized by a pivot axis P1 substantially parallel to planar surface 11 of the shower wall 10. The pivot joint coupling between the lower portion 104 of the wall shower bar assembly 100 and the shower wall 10, of course, is a true pivot or hinge joint characterized by a pivot axis P2 which is substantially planar to the surface 11 of the shower wall 10 and substantially parallel to the pivot axis P1 defined by the upper joint connection assembly 112.

Advantageously, both the upper retainer assembly 300 and the lower retainer assembly 400 may be independently coupled or uncoupled from the water supply pipe 12 and the shower wall 10, respectively. If the upper retainer assembly 300 is coupled to the water supply pipe 12 and the lower retainer assembly 400 is detached from the shower wall 10, the lower portion 104 of the wall shower bar assembly 100 is free to swing or pivot away from the shower wall 10, while the upper portion 102 of the wall shower bar assembly 100 is maintained a coupled or engaged condition with respect to the water supply pipe 12 by the upper retainer assembly 300. Conversely, if the lower retainer assembly 400 is coupled to the shower wall 10 and the lower retainer assembly 400 is detached from the water supply pipe 10, the upper portion 102 of the wall shower bar assembly 100 is free to swing or pivot away from the water supply pipe 12 and the shower wall 10, while the lower portion 104 of the wall shower bar assembly 100 is maintained in a coupled or engaged condition with the shower wall 10 by the lower retainer assembly 400. In one exemplary embodiment, an angle of pivoting away from the vertical shower wall 10 permitted by the upper spheroidal joint connection assembly 112 is approximately 30° and an angle of pivoting away from the vertical shower wall 10 permitted by the lower pivot joint connection assembly 114 is also approximately 30°.

The dual joint connection structure 110 of the wall shower bar assembly 110 of the present disclosure advantageously facilitates repair of the wall shower bar assembly 100, should repair or replacement of components be necessary. That is, if a repair is needed to the upper portion 102 of the wall shower bar assembly 100, the upper retainer assembly 300 may be disconnected from the water supply pipe 12 and swung away from the vertical wall 10 approximately 30° thereby providing access for repair of the wall shower bar assembly 100 while the lower retainer assembly 400 remains affixed to the shower wall 10. Similarly, if a repair is needed to the lower portion 102 of the wall shower bar assembly 100, the lower retainer assembly 400 may be disconnected from the shower wall 10 and swung away from the wall 10 approximately 30° thereby providing access for repair of the wall shower bar assembly 100 while the upper retainer assembly 300 remains affixed to the water supply pipe 12.

Moreover, the dual joint connection structure 110 of the wall shower bar assembly 100 provides for easier installation of the wall shower bar assembly 100 because of the relative adjustability or pivoting-type of both the upper and lower portions 102, 104 of the wall shower bar assembly 100 with respect to the shower wall 10 and the water supply pipe 12. Although, in one exemplary embodiment, the upper joint connection assembly is a spheroidal ball-and-socket or universal ball joint attachment structure 301, such a joint, of course, can also be viewed as a pivot joint because the structure has the functionality to pivot with respect to the shower wall 10 and the water supply pipe 12. This relative pivoting movement of both the upper and lower connection assemblies 112, 114 makes it easier for the installer to account for slight differences in the angle of the distal portion 13 of the water supply pipe 12, the horizontal offset of the threaded end 14 of the water supply pipe 12 from the shower wall 10, slight non-verticality of the shower wall 10, etc. when installing the wall shower bar assembly 100 of the present disclosure. As stated above, in one exemplary embodiment, an approximate swing or pivot angle permitted by the upper connection structure 112 is 30° and an approximate swing or pivot angle permitted by the lower connection structure 114 is 30°.

The wall shower bar assembly 100 of the present disclosure includes the upper retainer assembly 300, comprising the upper joint connection assembly 112, the lower retainer assembly 400, comprising the lower joint connection assembly 114, and a generally vertically-oriented tube assembly 112 including a hollow tube or tubular member 210 extending between the upper and lower retainer assemblies 300, 400. In one exemplary embodiment, the upper joint connection assembly 112 comprises a first joint attachment structure 301, while the lower joint connection assembly 114 comprises a second joint attachment structure 500. In one exemplary embodiment, the first joint attachment structure 301 comprises a spheroidal or ball joint attachment structure, while the second joint attachment structure 500 comprises a hinged joint attachment structure.

As is best seen in FIGS. 1, 6-7, and 8-9, the lower retainer assembly 400 includes a wall attachment assembly 405, the second hinged joint attachment structure 500 and a retainer body 450. The wall attachment assembly 405 in one exemplary embodiment comprises a suction cup attachment assembly 410. The retainer body 450, which defines a portion of the second hinged joint attachment structure 500, also defines the two-position diverter valve 480. The diverter valve 480 includes a valve body 482 (FIG. 9) rotatably supported within a cavity or chamber defined by a generally cylindrical valve housing 483. The valve body 482 is rotated within the valve housing 483 by a valve handle 484. The handle 484 is rotated between a first and a second position to selectively direct water from the water supply pipe 12 to the shower head 600 or to the hand-held sprayer shower 700. Rotation of the handle 484 rotates the valve body 482 within the valve housing 483.

Tube Assembly 200

As is best seen in FIGS. 1-6, the tube assembly 200 including the hollow tube or bar 210, a generally T-shaped three-way manifold 250, a fixed shower head 600 and a hand-held sprayer shower 700. The tube assembly 200 also includes a seat 800 slidably mounted on the tube 210. The seat 800 defines a support for releasably holding the hand-held shower 700.

Hollow Tube 210

Figure 6:
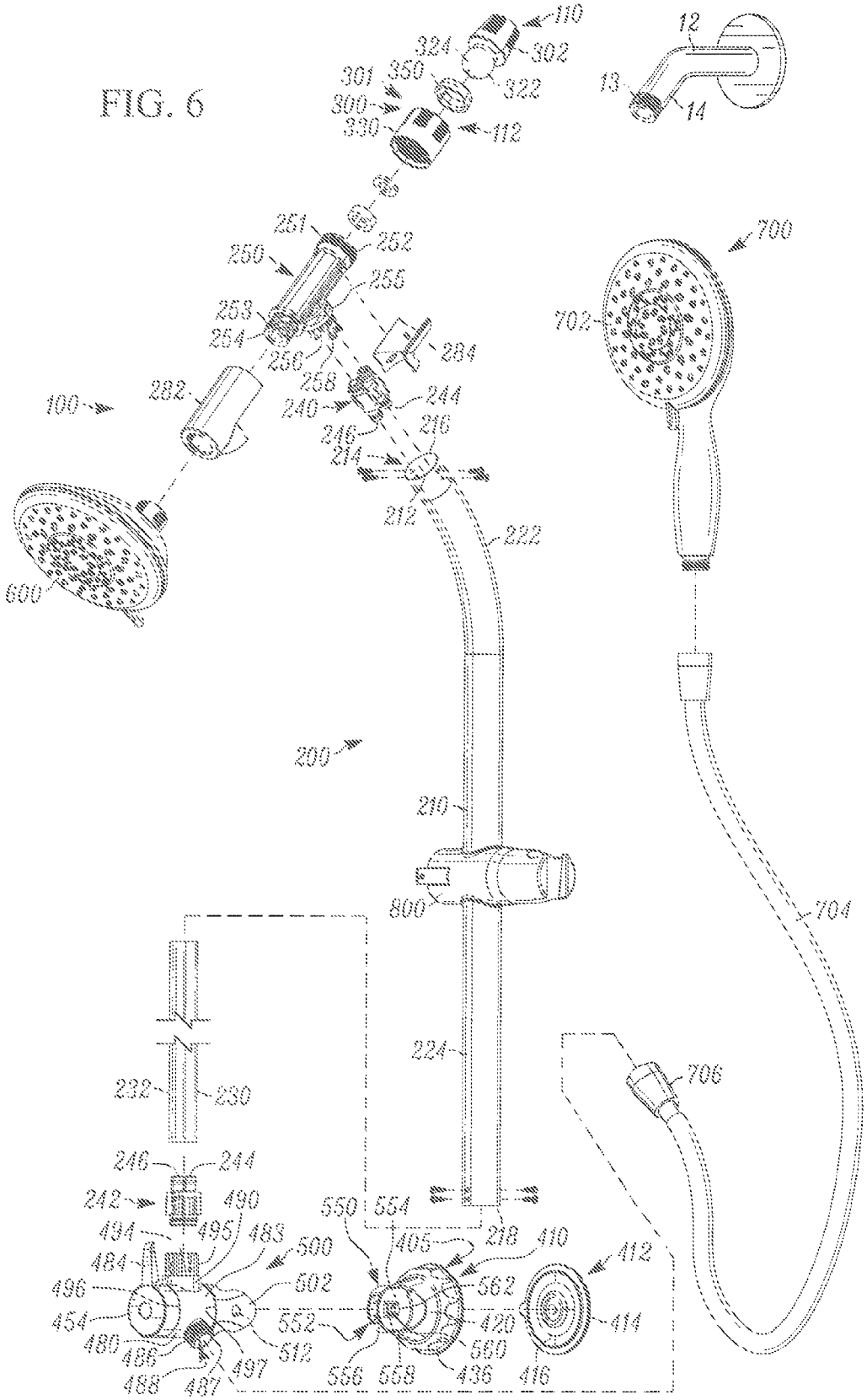
FIG. 6 is a schematic exploded front perspective view of the wall shower bar assembly of FIG. 1.

The tube or bar 210 is hollow and includes an inner or interior surface 212 defining a throughbore 214 extending between an upper end 216 and a lower end 218. The tube 210 defines a central longitudinal axis LA extending through the throughbore 214 of the tube 210 and includes a curved upper portion 222 and a generally straight central portion 224 that extends to the lower end 218. In the central portion 224 of the tube 210, the central longitudinal axis LA is substantially parallel to the planar surface 11 of the shower wall 10 and is oriented in the vertical direction V. As is schematically depicted in FIG. 6, a first, inlet water supply line 230 and a second, outlet water supply line 232 extend the through the throughbore 214 of the tube 210. A first fitting 240 is affixed at the upper end 216 of the tube 210 and a second fitting 242 is affixed at the lower end of the tube 210. The first and second fittings 240, 242 each include two ports 244, 246, one port 244 being in fluid communication with the first, inlet water supply line 230 and the second port 246 being in fluid communication with the second, outlet water supply line 232.

Manifold 250

Figure 8:
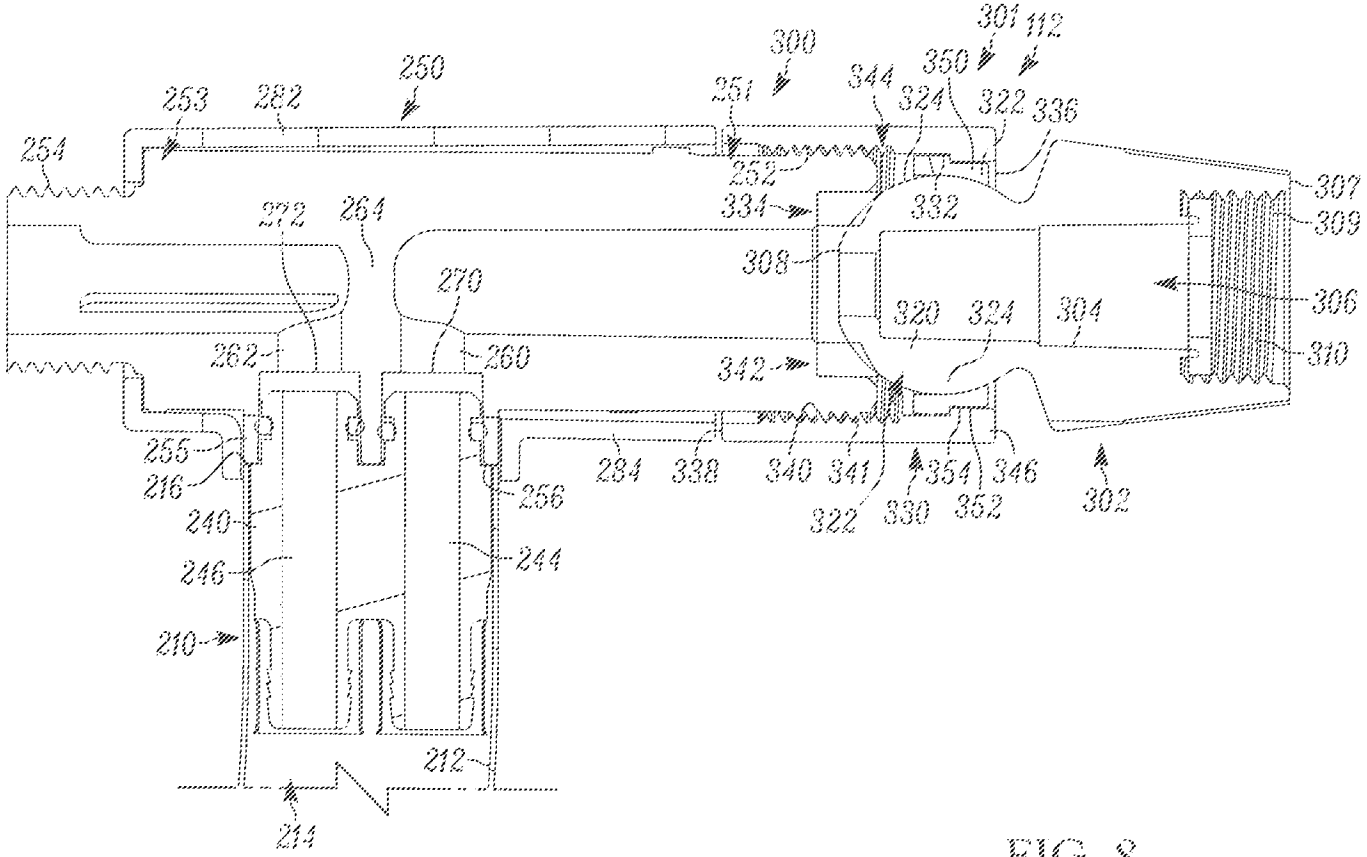
FIG. 8 is a schematic section view through an upper portion of the wall shower bar assembly of FIG. 1, including an upper retainer assembly, as seen from a plane indicated by the line 88 in FIG. 3.

As can best be seen in FIGS. 6 and 8, the generally T-shaped manifold 250 is affixed to the upper end 216 of the tube 210. The manifold 250 includes a first arm 251 defining a first external threaded end 252 coupled to the threaded end 14 of the water supply pipe 12 by the upper spheroidal joint connection assembly 112. The manifold 250 includes a second arm 253 defining a second external threaded end 254. The fixed shower head 600 is affixed to the second threaded end 254 of the manifold 250. The manifold 250 further includes a third arm 255 generally orthogonal to the first and second arms 251, 253. The third arm 255 includes an end portion 256 including axially extending tabs 258 that interfit into the upper end 216 of the hollow tube 210 between the wall of the tube 210 and the first fitting 240 and are secured by screws to affix the manifold 250 to the hollow tube 210 and the first fitting 240. The manifold 250 includes a pair of cover or trim pieces 282, 284 (FIG. 6) that enclose the manifold 250 and match the finish of the hollow tube 210 for aesthetic purposes.

An interior of the manifold 250 defines a first water chamber 260 and a second water chamber 262 separated by a central interior wall or diaphragm 264. The first water chamber 260 extends between and provides for fluid communication between the first threaded end 252 and the first inlet water supply line 230. The first inlet water supply line 230 is coupled, through the first fitting 240, to a first outlet port 270 of the first water chamber 260 at the end portion 256 of the third arm 255 of the manifold 250 That is, the first water chamber 260 of the manifold 250 directs water flowing from the water supply pipe 12 through the first outlet port 270 of the third arm 255, through the first fitting 240 and into the first inlet water supply line 230, the first inlet water supply line 230 being in fluid communication with the first water chamber 260. The first inlet water supply line 230 and the second fitting 242 are in fluid communication with and terminate at the valve body 482 of the two-way diverter valve 480.

The second water chamber 262 extends between and provides for fluid communication between the second water outlet supply line 232 and the second threaded end 254 of the manifold 250. The second outlet water supply line 232 is coupled, through the first fitting 240, to a second inlet port 272 of the second water chamber 262 at the end portion 256 of the third arm 255 of the manifold 250 That is, the second water chamber 262 of the manifold 250 directs water flowing from the second outlet water supply line 232 through the first fitting 240, through the second inlet portion 272 of the third arm 255 and through the second threaded end 254 and into the shower head 600.

The first inlet water supply line 230 is in fluid communication with the first water chamber 260 and the first outlet port 270 of the manifold 250, while the second outlet water supply line 232 is in fluid communication with the second water chamber 262 and the second inlet portion 272 of the manifold 250. In a first position of the diverter valve handle 484, the valve body 482 is oriented such that water is routed from the first inlet water supply line 230 through the valve body 482, through the second outlet water supply line 232, through the second water chamber 262 and, finally, to the shower head 600 where it exits the shower head 600 in a water spray pattern defined by the shower head 600. In a second position of the diverter valve handle 484, the valve body 482 is oriented such that water is routed from the first inlet water supply line 230 through the valve body 482, through an outlet port 488 of a lower arm 486 of the valve housing 483 of the diverter valve 480 and, finally, to the hand-held sprayer shower 700 where it exits the sprayer shower 700 in a water spray pattern defined by the sprayer shower 700.

Upper Retainer Assembly 300

As is best seen in FIGS. 1, 6 and 8, the upper retainer assembly 300 releasably affixes the upper portion 102 of the wall shower bar assembly 100 to the water supply pipe 12 via a jointed connection. The upper retainer assembly 300 includes the upper joint connection assembly 112 which, in one exemplary embodiment, comprises the first ball and socket joint or ball joint or spheroidal joint attachment structure 301. More specifically, in one exemplary embodiment, the upper joint connection assembly 112 includes: a) a coupler 302 coupled at a front end 307 (in a forward direction F toward the shower wall 10) to the threaded end 14 of the water supply pipe 12 and defining at a back end 308 a spheroidal ball 324 of the ball-and-socket attachment structure 301, b) a collar 330 coupled at a back end 338 to the first threaded end 252 of the first arm 251 of the manifold 250 and defining at a front end 336 a spheroidal opening or socket 344 of the ball-and-socket attachment structure 301; and c) a retaining ring/seal 350 interposed between the ball 324 of the coupler 302 and the socket 344 of the collar 330 to maintain the ball 324 within the socket 344 while permitting the pivoting and swiveling action of the ball-and-socket attachment structure 301 between the coupler 302 and the collar 330. A horizontal axis drawn through the center of the ball 324 defines the pivot axis P1 of the first spheroidal joint attachment structure 301. To the extent that the upper portion 102 of the wall shower bar assembly 100 is moved in the vertical direction D (up and/or down), the spheroidal joint attachment structure 301 would function as a pivot joint and would pivot about the pivot axis P1.

The coupler 302 includes an interior surface 304 defining a throughbore 306. The interior surface 304 of a front portion 309 of the coupler 302 defines interior threads 310 that engage the threaded end 14 of the water supply pipe 12. A rear portion 320 of the coupler 302 defines a first male connector 322 which, in one exemplary embodiment, is the spheroid or ball 324 of the ball-and-socket joint attachment structure 301.

The collar 330 includes an interior surface 332 defining a throughbore 334 generally aligned with the longitudinal axis LA of the tube 210. The throughbore 334 of the collar 330 is larger than an outer diameter of the ball 324 of the coupler 302. Thus, even at the most extreme pivot angle (e.g., 30°) or position of the collar 330 with respect to the coupler 302, the respective thoughbores 334, 306 overlap along the longitudinal axis LA of the tube 210 to permit fluid communication through the first joint attachment structure 301 from the water supply pipe 12 to the first water chamber 260 of the manifold 250. The interior surface 332 of the collar 330 defines threads 340 which engage the first threaded end 252 of the first arm 251 of the manifold 250. The back end 338 of the collar 330 includes a radially inwardly stepped shoulder 346. The shoulder 346 and a rear interior portion 342 of the collar 330 define the first female connector 341, which, in one exemplary embodiment, is the socket 344 of the ball-and-socket joint attachment structure 301.

The retaining ring/seal 350 bears against the stepped shoulder 346 formed at the back end 338 of the collar 330. An inner diameter of the retaining ring/seal 350 is smaller than an outer diameter of the ball 324 of the coupler 302 to trap or maintain the ball 324 within the socket 344 of the collar 330 thereby forming the universal joint attachment structure 301. The outer diameter of the retaining ring/seal 350 is larger than the opening formed by the throughbore 334 at the back end 338 of the collar 330 thus sandwiching and maintaining the position of the retaining ring/seal 350 between ball 324 of the coupler 302 and the stepped shoulder 346 of the collar 330. An outer peripheral surface 352 of the retaining ring/seal 350 includes a step 354. The step 354 of the retaining ring/seal 350 of seats on the stepped shoulder 346 of the collar 330 to retain the ball 324 in the socket 344.

Advantageously, the wall shower bar assembly 100 of the present disclosure includes two or dual threaded connections for the upper ball joint connection assembly 112, each of which can be independently tightened or loosened. That is, the first spheroidal joint attachment structure 301 features one threaded connection between the coupler 302 and the water supply pipe 12 and a second threaded connection between the collar 350 and the first arm 251 of the manifold 250. This configuration of dual threaded connections for the upper ball joint connection assembly 112 mitigates the problem of overtightening a coupling collar when a ball joint assembly with a single coupling collar was used to affix the upper portion of the wall shower bar assembly to the water supply pipe, as previously discussed. Generally and advantageously, with the spheroidal joint attachment structure 301 of the present disclosure, finger tightening the threaded connection between the coupler 302 and the water supply pipe 12 and finger tightening the threaded connection between the collar 350 and the first arm 251 of the manifold 250 are sufficient to provide watertight seals between the water supply pipe 12 and the wall shower bar assembly 100.

Lower Retainer Assembly 400

As is best seen in FIGS. 1, 6-7, and 9-10, the lower retainer assembly 400 of the wall shower bar assembly 100 of the present disclosure includes the retainer body 450, the wall attachment assembly 405 for securing the lower portion 104 of the wall shower bar assembly 100 to the support structure such as the shower wall 10, and further includes the lower joint connection assembly 114 providing the hinged joint attachment structure 500 between the lower portion 104 of the shower bar assembly 100 and the shower wall 10.

Diverter Valve 480

In one exemplary embodiment, the lower retainer assembly 400 includes the lower joint connection assembly 114 pivotally disposed between the retainer body 450 and the wall attachment assembly 405. In one exemplary embodiment, the retainer body 450 includes the two-position diverter valve 480. As is best seen in FIG. 9, the diverter valve 480 includes the valve body 482 rotatable within the cavity or chamber defined by the generally cylindrical valve housing 483. The valve body 482 is selectively rotated between two positions by the valve handle 484. The valve housing 483 includes a lower arm 486 having a threaded exterior distal end 487 for threaded engagement by a threaded end connector 706 of the hose 704 of the hand-held sprayer shower 700. The valve housing lower arm 486 defines an outlet port 488 that is selectively blocked or opened by the diverter valve body 482, depending on the position of the valve handle 484. In the open position, the outlet port 488 is in fluid communication with the first inlet water supply line 230 and the second fitting 242 such that water from the water supply pipe 12 is routed through the outlet port 488 and through the hose 704 and ultimately to the hand-held sprayer shower 700.

The valve housing 483 also includes an upper arm 490. The upper arm 490 defines a first inlet port 491 and a second outlet port 492 (FIG. 10). The first inlet port 491 provides fluid communication from the first inlet water supply line 230 to the valve housing chamber. The second outlet port 492 is selectively blocked or opened by the diverter valve body 482, depending on the position of the valve handle 484. In the open position, the second outlet port 492 is in fluid communication with the first inlet water supply line 230 such that water from the water supply pipe 12 is routed through the second outlet port 492, through the second fitting 242, through the second outlet water supply line 232 and through the manifold 250 and ultimately to the fixed head shower 600. The upper arm 490 includes an end portion 494 with axially extending tabs 495 that extend into the hollow tube 210 between the wall of the tube 210 and the second fitting 242 are secured by screws to affix the retainer body 450 to the hollow tube 210 and the second fitting 242. A first end 496 of the cylindrical valve housing 483 provides a rotatable seating surface for the diverter valve handle 484 while the second end 497 of the cylindrical valve housing 483 provides a fixed seating surface for a clevis 502 of the second joint attachment structure 500.

Lower Joint Connection Assembly 114

Figure 7:
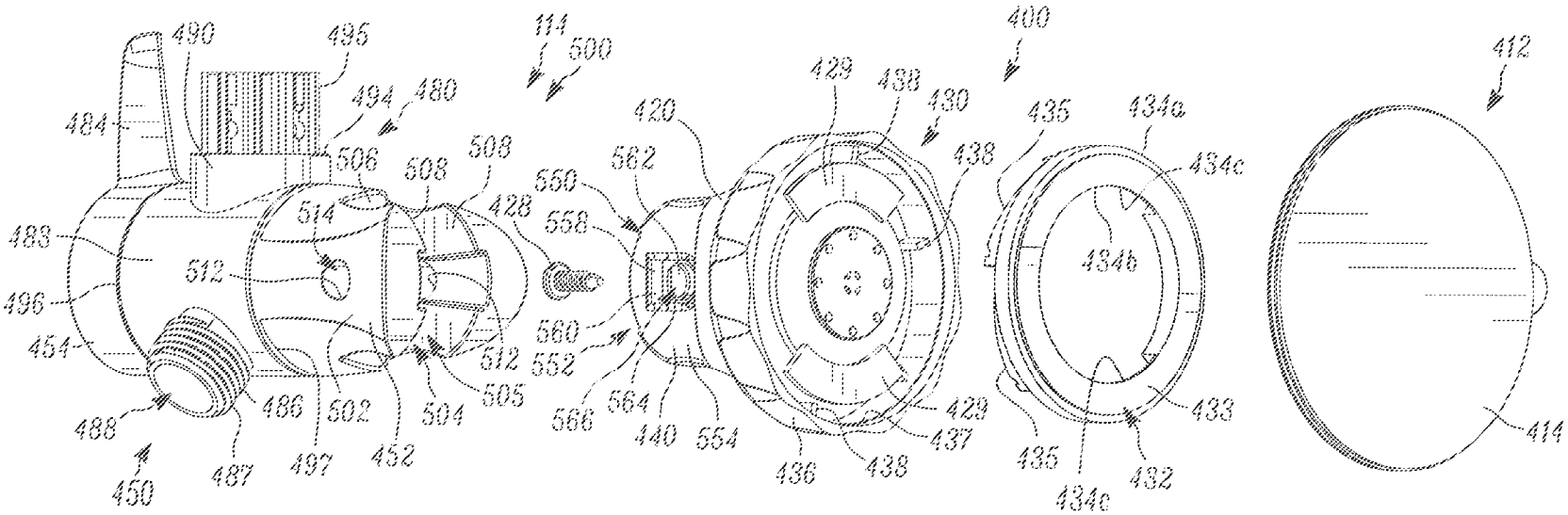
FIG. 7 is a schematic exploded rear perspective view of a lower portion of the wall shower bar assembly of FIG. 1, including a lower retainer assembly.

As best seen in FIGS. 6-7 and 10, the lower joint connection assembly 114 comprises a pivot joint or hinge joint defined by the second joint attachment structure 500. The second joint attachment structure 500 includes the retainer body 450 which includes a forward portion 452, defining the clevis 502, and a rearward portion 454, defining the rotatable diverter valve handle 484. The clevis 502 is part of the hinged joint attachment structure 500. A second part of the hinged joint attachment structure 500 is defined by a vertically-oriented tongue 500 formed at a tapered rearward end 440 of the suction cup housing 420 of the suction cup attachment assembly 405.

The clevis 502 includes a slotted opening 504 that extends vertically through the clevis 502. The slotted opening 504 defines a first female connector 505 and is defined by a back wall 506 and parallel, opposing side walls 508. There is generally V-shaped projection 510 extending forwardly from the back wall 506. Additionally, each of the side walls 508 includes a generally horizontal opening 512. The two openings 512 of the side walls 508 are aligned to form an axle bushing 514. A center line through the axle bushing 514 defines the pivot axis P2 of the hinged attachment structure 500.

The vertically-oriented tongue 550 formed at the tapered rearward end 440 of the suction cup housing 420 defines a second connector 552 that interfits with the first connector 505 defined by the clevis 502. The tongue 550 is defined by a pair of spaced apart, opposing side walls 554 joined along an outer periphery by an outer wall 556. The side walls 554 each include a cut-out region 558 that defines a tab 560. An outwardly extending axle stub 562 is formed on each of the tabs 560. The axle stubs 562 are horizontally aligned so as to form a discontinuous axle 564. The tongue 550 also includes a generally U-shaped opening 570 in the outer wall 556 and between the side walls 554. The U-shaped opening 570 is partly defined by a pair of shoulders 572 that, if extended, would have a vertex or center on or near the pivot axis P2.

When the tongue 550 of the suction cup housing 420 is assembled to the clevis 502 of the retainer body 450, the tabs 560 flex inwardly as they move along the clevis side walls 508. Upon proper alignment of the two axle stubs 562 of the tabs 560 of the tongue 550 with the two openings 512 of the side walls 508 of the retainer body 450, the axle stubs 562 snap fit or seat into respective openings 512 to form a hinge. Stated another way, the interfit of the axle stubs 562 into the openings 512 of the retainer body clevis 502 define a discontinuous hinge 566 between the tongue 550 of the suction cup housing 420 and the clevis 502 of the retainer body 450. The swing or pivot angle of the hinged joint attachment structure 500 about the pivot axis P2 is limited by contact between the V-shaped projection 510 of the slotted opening 504 of the clevis 502 and the shoulders 572 of the U-shaped opening 570 of the tongue 550 of the suction cup housing 420.

Wall Attachment Assembly 405

As best seen in FIGS. 6-7 and 9-10, the wall attachment assembly 405, in one exemplary embodiment, comprises the suction cup attachment assembly 410 that releasably affixes the lower portion 104 of the wall shower bar assembly 100 to the planar surface 11 defined by the shower wall 10. The suction cup attachment assembly 410 comprises a flexible suction cup 412 having a front side 414 facing the shower wall 10 and a back side 416 facing the retainer body 450. The front side 414 of the suction cup 412 is generally convex and becomes substantially flat when urged against the shower wall by an annular advancement ring 432 that contacts the back side 416 of the suction cup 412, as explained below. The suction cup 412 may be fabricated of low durometer polyurethane or other similar material with excellent suction adhesion characteristics. Optionally, the front surface 414 of the suction cup 412 may include a coating of adhesive for enhanced adhesion to the shower wall 10.

In one exemplary embodiment, as best seen in FIG. 9, a central stationary base 422 extends axially forward from the suction cup housing 420. The back side 416 of the suction cup 412 is affixed to the central base 422. In one exemplary embodiment, the back side 416 of the suction cup 412 includes a ribbed, axially extending projection 418 which is received in a ribbed receptacle 425 of the base 422 of the suction cup housing 420 to secure the suction cup 412 to the suction cup housing 420. A stem 424 of the base 422 extends axially rearwardly and interfits into a keyed opening 426 (FIG. 9) defined by the housing 420. The stem 424 includes a threaded opening and a screw 428 is threaded into the stem threaded opening to secure the base 422 to the housing 420. The base 422 includes two radially extending wings 429.

Advantageously, the suction cup attachment assembly 410 of the present disclosure includes a camming mechanism 430 to urge the suction cup 412 against the shower wall 10 to expel air trapped between the front side 414 of the suction cup 412 and the shower wall 10 and thereby improve the strength of the suction seal between the suction cup 412 and the shower wall 10. The camming mechanism 430 includes the annular advancement ring 432 and a rotatable cam dial 436. The rotatable cam dial 436 is rotatably mounted on the stem 424 of the base 422. The cam dial 436 includes an inner surface 437 defining a series of radially spaced, axially extending ribs 448, which function as cams, as explained below, when the cam dial 436 is rotated (about 60° degrees) to axially advance the advancement ring 432 against the shower wall 10 and thereby insure a strong suction seal between the suction cup 412 and the shower wall 10. In one exemplary embodiment, the number of ribs 448 of the cam dial 436 is six.

The advancement ring 432 includes an annular front face 433 that contacts the back side 416 of the suction cup 412. The advancement ring 432 further includes an outer peripheral rim 434*a* extending rearwardly from an outer edge of the annular front face 433 and an inner peripheral rim 434*b* extending rearwardly from an inner edge of the annular front face 433. The inner peripheral rim 434*b* of the advancement ring 432 includes a pair of recesses 434*c* (FIG. 7) that receive the two radially extending wings 429 of the base 422 to insure that the advancement ring 432 does not rotate with the cam dial 436 when the cam dial 436 is rotated, but rather, the advancement ring 432 remains rotationally stationary with the suction cup housing 420 and the affixed central base 422 when the cam dial 436 is rotated. The outer peripheral rim 434 includes a plurality of sawtooth profiles 435 that function as a camming surface for the cams defined by the ribs 448 of the cam dial 436. In one exemplary embodiment, the number of sawtooth profiles 435 is six.

The inclined portions of the sawtooth profiles 435 bear against respective ones of the ribs 448 of the cam dial 436. As the cam dial is rotated, the ribs 448 of the cam dial 436 rotate with respect to the sawtooth profiles 435 of the advancement ring 432, the ribs 448 "ride up" the inclined portions of the respective sawtooth profiles 435 thereby forcing the advancement ring 432 to more axially forward against the back side 416 of the suction cup 412. Each of the sawtooth profiles 435 include a notch near the top of the profile. The notches receive the respective ribs 448 of the cam dial 436 to maintain an advanced position of the advancement ring 432 against the suction cup 412 and thus a "locked in" position of the suction cup attachment assembly 410 with respect to the shower wall 10.

To loosen and remove the suction cup attachment assembly 410 from the shower wall 10, the user will rotate the cam dial 436 in the opposite direction approximately 60° whereby the advancement ring 432 will be moved axially in the rearward direction away from the back side 416 of the suction cup 412 allowing the user to a rock the lower portion 104 of the wall shower bar assembly 100 and release the suction seal between the suction cup 412 and the shower wall 10.

The components of the wall shower bar assembly 100 of the present invention may be fabricated of metals, such as, but not limited to steel, stainless steel, steel alloys, aluminum, or various plastic or polymer materials or various composite materials that provide for sufficient strength and durability and provide for water, heat and humidity resistance so as to be suitable for use in a wet, humid, hot shower stall environment. The components of the shower bar assembly 100 may be fabricated by machining, forming, casting, forging, extrusion, injection molding, or other fabrication techniques know to those of skill in the art.

As used herein, terms of direction and/or orientation such as vertical, horizontal, vertically, horizontally, forward, rearward, backward, longitudinally, upper, lower, inward, outward, axially, radially, etc., are provided for convenience purposes and relate generally to the orientation shown in the Figures. Such direction and/or orientation terms are not intended to limit the scope of the present disclosure or the claims appended hereto.

What have been described above are examples of the present disclosure/invention. It is, of course, not possible to describe every conceivable combination of components, assemblies, or methodologies for purposes of describing the present disclosure/invention, but one of ordinary skill in the art will recognize that many further combinations and permutations of the present disclosure/invention are possible. Accordingly, the present disclosure/invention is intended to embrace all such alterations, modifications, and variations that fall within the spirit and scope of the appended claims.

What is claimed is:

1. A wall shower bar assembly for mounting to a shower wall and a water supply pipe extending from the shower wall, the wall shower bar assembly comprising:

a) a tube assembly including a tube, a manifold affixed to an upper end of the tube, and a shower head, the manifold including a first arm defining a first end, a second arm defining a second end, and a third arm defining a third end, the third arm being transverse to the first and second arms, the shower head coupled to the second end of the manifold, the tube including first and second water supply lines extending longitudinally through a longitudinal throughbore of the tube and a fitting affixed at the upper end of the tube, the fitting including a first port in fluid communication with the first water supply line and a second port in fluid communication with the second water supply line, the third end of the manifold including a first port and a second port, the manifold further including a first water chamber in fluid communication between the first end and the first port of the third end of the manifold and a second water chamber in fluid communication between the second end and the second port of the third end of the manifold, the first port of the third end of the manifold being in fluid communication with the first water supply line through the first port of the fitting and the second port of the third end of the manifold being in fluid communication with the second water supply line through the second port of the fitting, the third end of the manifold including axially extending tabs that interfit into the upper end of the tube:

b) an upper retainer assembly coupling the tube assembly to the water supply pipe, the upper retainer assembly including an upper joint connection assembly having a first coupler releasably affixed to the water supply pipe, a collar affixed to the first end of the manifold and a first connector coupling the coupler and the collar for relative movement between the coupler and the collar; and c) a lower retainer assembly coupling the tube assembly to the shower wall, the lower retainer assembly including a retainer body affixed to a lower end of the tube, a wall attachment assembly releasably affixed to the shower wall, and a lower joint connection assembly, the lower joint connection assembly including a first member extending from the retainer body, a second member extending from the attachment assembly, and a second connector coupling the first and second members for relative movement between the first and second members.

2. The wall shower bar assembly of claim 1 wherein the first connector of the upper joint connection assembly comprises a spheroidal joint for ball joint movement between the coupler and the collar.

3. The wall shower bar assembly of claim 1 wherein the second connector of the lower joint connection comprises as hinge joint for pivoting movement between the first and second members.

4. The wall shower bar assembly of claim 3 wherein one of the first and second members comprises a clevis and another of the first and second members comprises a tongue interfitting in the clevis for relative pivoting movement about a pivot axis substantially parallel to the shower wall.

5. The wall shower bar assembly of claim 1 wherein the wall attachment assembly includes a suction cup attachment assembly comprising a flexible suction cup, a suction cup housing supporting the suction cup, and a camming mechanism including an advancement ring to contact and urge the suction cup against the shower wall.

6. The wall shower bar assembly of claim 1 wherein the retainer body comprises a diverter valve.

7. A wall shower bar assembly for mounting to a shower wall and a water supply pipe extending from the shower wall, the shower bar assembly comprising:

a) a tube assembly including a tube defining a longitudinal axis and a manifold affixed to an upper end of the tube, a shower head, a hand-held shower slidably supported on the tube, the manifold including a first arm defining a first end, a second arm defining a second end, and third arm defining a third end, the third arm being transverse to the first and second arms, the shower head coupled to the second end of the manifold, the tube including first and second water supply lines extending longitudinal through a longitudinal throughbore of the tube and a fitting affixed at the upper end of the tube, the fitting including a first port in fluid communication with the first water supply line and a second port in fluid communication with the second water supply line, the third end of the manifold including a first port and a second port, the manifold further including a first water chamber in fluid communication between the first end and the first port of the third end of the manifold and a second water chamber in fluid communication between the second end and the second port of the third end of the manifold, the first port of the third end of the manifold being in fluid communication with the first water supply through the first port of the fitting and the second port of the third end of the manifold being in fluid communication with the second water supply line through the second port of the fitting, the third end of the manifold including axially extending tabs that interfit into the upper end of the tube;

b) an upper retainer assembly coupling the tube assembly to the water supply pipe, the upper retainer assembly including an upper joint connection assembly coupling the first end of the manifold to a the water supply pipe, the upper joint connection assembly including a first coupler coupled to the water supply pipe, a collar coupled to the first end of the manifold and a first connector coupling the coupler and the collar for relative movement between the coupler and the collar; and c) a lower retainer assembly coupling a lower end of the tube to the shower wall, the lower retainer assembly including a wall attachment assembly and a lower joint connection assembly coupled between the lower end of the tube and the wall attachment assembly, the lower joint connection assembly including a first member coupled to the lower end of the tube, a second member affixed to the wall attachment assembly, and a second connector coupling the first and second members for relative movement between the first and second members.

8. The wall shower bar assembly of claim 7 wherein the first connector of the upper joint connection assembly comprises a spheroidal joint for ball joint movement between the coupler and the collar.

9. The wall shower bar assembly of claim 7 wherein the second connector of the second joint attachment structure of the lower joint connection comprises a hinge joint for pivoting movement between the first and second members.

10. The wall shower bar assembly of claim 9 wherein one of the first and second members comprises a clevis and another of the first and second members comprises a tongue interfitting in the clevis for relative pivoting movement about a pivot axis substantially parallel to the shower wall.

11. The wall shower bar assembly of claim 7 wherein the wall attachment assembly includes a suction cup attachment assembly comprising a flexible suction cup, a suction cup housing supporting the suction cup, and a camming mechanism including an advancement ring to contact and urge the suction cup against the shower wall.

12. The wall shower bar assembly of claim 7 wherein a retainer body is affixed to the lower end of the tube and the retainer body comprises a diverter valve.

13. A wall shower bar assembly for mounting to a shower wall and a water supply pipe extending from the shower wall, the shower bar assembly comprising:

of a bar assembly including a tube defining a longitudinal axis and a manifold affixed to an upper end of the tube, a shower head, a hand-held shower slidably supported on the tube, the manifold including a first arm defining a first end, a second arm defining a second end, and a third arm defining a third end, the third arm being transverse to the first and second arms, the shower head coupled to the second end of the manifold, the tube including first and second water supply lines extending longitudinally through a longitudinal throughbore of the tube and a fitting affixed at upper end of the tube, the fitting including a first port in fluid communication with the first water supply line and a second port in fluid communication with the second water supply line, the third end of the manifold including a first port and a second port, the manifold further including a first water chamber in fluid communication between the first end and the first port of the third end of the manifold and a second water chamber in fluid communication between the second end and the second port of the third end of the manifold, the first port of the third end of the manifold being in fluid communication with the first water supply line through the first port of the fitting and the second port of the third end of the manifold being in fluid communication with the second water supply line through the second port of the fitting, the third end of the manifold including axially extending tabs that interfit into the upper end of the tube;

b) an upper joint connection assembly coupling the first end of the manifold to a the water supply pipe, the upper joint connection assembly including a first coupler coupled to the water supply pipe, a collar coupled to the first end of the manifold and a first connector coupling the coupler and the collar for relative movement between the coupler and the collar; and c) a lower retainer assembly coupling a lower portion of the tube to the shower wall, the lower retainer assembly including a wall attachment assembly releasably attached to the shower wall and a lower joint connection assembly coupled between the lower portion of the tube and the wall attachment assembly, the wall attachment assembly comprising a suction cup attachment assembly including as flexible suction cup, a suction cup housing supporting the suction cup, and a camming mechanism including a cam dial defining a cam and an advancement ring defining a camming surface engaged by the cam, rotation of the cam dial moving the advancement ring axially against the suction cup to urge the suction cup against the shower wall.

14. The wall shower bar assembly of claim 13 wherein the lower joint connection assembly includes a first member coupled to the lower portion of the tube, a second member affixed to the wall attachment assembly, and a second connector coupling the first and second members for relative movement between the first and second members.

15. The wall shower bar assembly of claim 14 wherein the second connector of the lower joint connection assembly comprises a hinge joint for relative pivoting movement between the first and second members.

16. The wall shower bar assembly of claim 15 wherein one of the first and second members comprises a clevis and another of the first and second members comprises a tongue interfitting in the clevis for relative pivoting movement about a pivot axis substantially parallel to the shower wall.

17. The wall shower bar assembly of claim 13 wherein the first connector of the upper joint connection assembly comprises a spheroidal joint for ball joint movement between the coupler and the collar.

18. The wall shower bar assembly of claim 13 wherein a retainer body is affixed to the lower end of the tube and the retainer body comprises a diverter valve.

19. The wall shower bar assembly of claim 1 wherein the axially extending tabs of the third end of the manifold interfit between the tube and the fitting.

20. The wall shower bar assembly of claim 7 wherein the axially extending tabs of the third end of the manifold interfit between the tube and the fitting.

* * * * *